US005107603A

United States Patent [19]

Durazzani

[11] Patent Number: 5,107,603

[45] Date of Patent: Apr. 28, 1992

[54] CLOTHES-DRYER HAVING INTEGRATED HOT-AIR ACCESSORIES

[75] Inventor: Pietro Durazzani, Pordenone, Italy

[73] Assignee: Zanussi Elettrodomestici S.p.A., Pordenone, Italy

[21] Appl. No.: 759,169

[22] Filed: Sep. 13, 1991

[30] Foreign Application Priority Data

Sep. 25, 1990 [IT] Italy ..... 45755 A/90

[51] Int. Cl.[5] ..... F26B 218/00

[52] U.S. Cl. ..... 34/44; 34/91; 34/133 R; 34/90

[58] Field of Search ..... 34/90, 91, 235, 133 R, 34/44, 48, 54, 55

[56] References Cited

U.S. PATENT DOCUMENTS 2,827,276 3/1958 Racheter ..... 34/91
3,064,360 11/1962 Sholin ..... 34/91
3,157,475 11/1964 Stainbrook ..... 34/91
3,197,886 8/1965 Brame et al. ..... 34/90
3,289,313 12/1966 Lechner, Jr. et al. ..... 34/91
4,868,998 9/1989 Rubin ..... 34/91

*Primary Examiner*—Henry A. Bennet
*Assistant Examiner*—Denise L. F. Gromada
*Attorney, Agent, or Firm*—Wenderoth, Lind & Ponack

[57] ABSTRACT

A clothes-dryer includes accessories such as a hair-dryer, hand-dryer and space heater, as well as a ventilation device for venting the room in which the dryer is disposed of undesirable air. The dryer includes an intake channel and a discharge channel which together with the basket of the dryer form a drying circuit along which a forced hot air supply flows to dry laundry contained in the basket during the normal operation of the dryer. A selection control device is provided to establish various modes of operation of the dryer in which the accessories are operated with the air supply which is normally produced when the dryer is used to dry clothes contained in the basket.

14 Claims, 2 Drawing Sheets

CLOTHES-DRYER HAVING INTEGRATED HOT-AIR ACCESSORIES

BACKGROUND OF THE INVENTION

The present invention relates to a clothes-dryer, and in particular a clothes-dryer provided with various accessories which can be run off of the same drying circuit of the dryer.

Known domestic washer/dryers comprise at least one ventilation device (fan) for forcing air through the laundry basket of the dryer, and at least one resistive heating element for heating the air which is forced through the laundry basket, whereby a load of clothes contained in the basket is dried by the heated air. Thus, such known domestic washer/dryers can be considered basically as forced air heaters.

It is also known that various appliances can be found in residential bathrooms to perform tasks which are frequently carried out in bathrooms. For example, small hair-dryers are universally used in residential bathrooms to dry one's hair, hands or even the coat of some domestic animals, such as dogs.

It is also desirable for the residential bathroom to be heated better than some of the other rooms in the house, especially in the winter time. Some residential bathrooms have individual electrical heating units installed therein, whereby a quantity of heat in addition to that provided by the home heating system can be readily supplied.

Finally, disagreeable odors and/or a high degree of humidity are often produced in the bathroom. Ventilation devices have been conventionally used to eliminate these odors and/or humidity. Such ventilation devices typically comprise a fan which aspirates the air from the inside of the bathroom, preferably from the upper portion thereof where the hottest air having the highest degree of humidity is concentrated. Such air is generally drawn from the bathroom and forced through a channel to the exterior of the residence.

It is also known that in some parts of the world domestic washing machines and clothes dryers have-been installed in the bathroom. In such cases, however, a number of apparatuses which are cumbersome and occupy a significant amount of space will be undesirably concentrated in the bathroom. Since all of such apparatuses typically are electrical appliances, safety in the bathroom is compromised not to mention an increase in utility costs.

SUMMARY OF THE INVENTION

It is, therefore, one object of the present invention to provide a clothes dryer having at least one frequently used appliance integrated therewith, and which appliance forms an accessory that can be run off of the drying circuit along which forced hot air otherwise passes to dry a load of clothes contained in the dryer.

Such appliances integrated with the clothes dryer include at least one of those discussed above, i.e. a hair-dryer, a hand-dryer, and/or a space heater. In addition, the clothes dryer according to the present invention can be operated in a mode in which the dryer merely aspirates odors and/or humidity from the room in which the dryer is located.

The object of the present invention is achieved by the provision of fan means and heater means for producing a supply of forced hot air in the dryer, and a selection control device which selectively supplies the forced hot air to a respective one of the accessories of the dryer.

In this way, the same forced hot air supply which is typically produced to dry clothes accommodated in the laundry basket of the dryer can selectively be used to run the various other appliances integrated with the clothes dryer, such as the hair-dryer and/or hand-dryer and/or space heater. In addition, if the selection control device is operatively connected to the fan means and heating means, then the heating means can be turned off while the fan means is operated whereby the dryer can operate in a mode in which the room in which the dryer is disposed can be readily ventilated.

BRIEF DESCRIPTION OF THE DRAWINGS

The above object, features and advantages of the present invention will be better understood from the following detailed description thereof made with reference to the accompanying drawings in which.

DETAILED DESCRIPTION OF THE PREFERRED EMBODIMENTS

Figure 1:
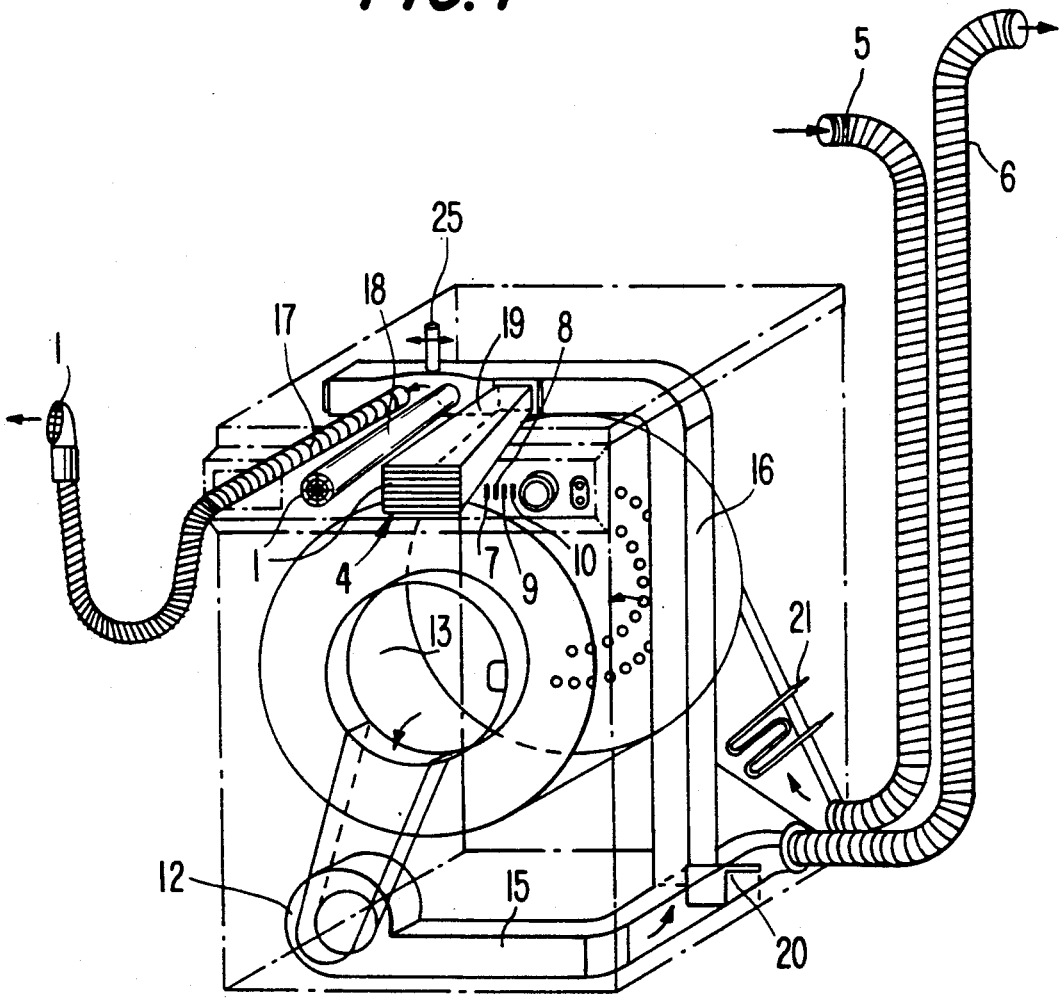
FIG. 1 is a schematic diagram of a clothes dryer according to the present invention.

Reference will now be made to FIG. 1, showing a non-limiting example of a domestic, front-loading washer/dryer according to the present invention.

Reference numeral 1 designates a plurality of hot-air utility openings open to the exterior of the dryer. Reference numeral 17 designates a flexible air-hose defining a first one of the hot-air utility openings 1 in an end thereof. A nozzle 18 defines a second one of the hot-air utility openings 1 at a respective end thereof communicating with the exterior of the dryer. And, reference numeral 4 designates a grill mounted to a duct 19 of the dryer at the outside thereof and defining a third one of the hot-air utility openings 1 communicating with the exterior of the dryer. These elements will serve to constitute a hair-dryer, a hand-dryer and a space heater under various modes of operation, which modes of operation will be described in more detail further on in the present specification.

The dryer also comprises a basket 13 for accommodating a load of clothes to be dried. An intake channel 5 communicates with the interior of the basket 13 and with the exterior of the dryer. The intake channel 5 defines a path along which air from the exterior of the dryer can pass in the direction shown by the arrows to the interior of the basket 13 so as to dry a load of clothes contained in the basket.

Heating means 21, in the form of an electrical resistance heating element, is provided in operative association with the intake channel 5 for heating air which is drawn into the intake channel 5. A discharge channel 6 communicates with the interior of the laundry basket 13, via conduit 15, and with the exterior of the dryer. The discharge channel thus defines a path along which air can be vented from the interior of the basket 1 to the exterior of the dryer, as also shown by the arrows in FIG. 1.

The intake channel 5 and the discharge channel 6 thus constitute a drying circuit with the interior of the basket 13, that is a circuit along which a forced hot air supply passes to normally heat and dry a load of clothes contained in the basket 13.

Fan means 12, in the form of a fan or other known ventilation device, is operatively associated with the drying circuit mentioned above for drawing air from the exterior of the dryer into the intake channel 5.

At least one hot-air utility conduit 16 communicates with the hot-air utility openings 1, and with the drying circuit at a location downstream of the heating means 21 with respect to the direction in which air will be induced to flow through the drying circuit by fan means 12. In the illustrated embodiment, the at least one hot-air utility conduit 16 is a single conduit connected to conduit 15 and communicating with each of the utility openings 1 via the flexible air-hose 17, the nozzle 18, and the duct 19 to which grill 4 is mounted, respectively.

Selection control means are provided for selectively respectively opening the hot-air utility openings 1 to the drying circuit while closing the discharge channel 6, and collectively closing the hot-air utility openings 1 to the drying circuit while opening the discharge channel 6. The selection control means and the operation of the dryer according to the present invention will now be described in more detail below.

The selection control means includes a deflector 20 disposed at that location at which the hot-air utility conduit 16 communicates with the drying circuit. The deflector is moveable, and in the illustrated embodiment pivotable, by a conventional driving device (not shown) between a first position shown by solid lines at which the deflector 20 blocks the flow of air through the drying circuit (i.e. to the discharge channel 6) while opening the hot-air utility conduit 16 to the drying circuit, and a second position shown by phantom lines in which the deflector 20 closes the hot-air utility conduit 16 to the drying circuit.

The selection control means also includes a gate 25 disposed in the hot-air utility conduit 16. The gate has an aperture therethrough. The gate is moveable by a known linear drive (not shown) in the directions shown by the double-headed arrow between respective positions at which the aperture is placed in communication with one of the hot-air utility openings 1 while the gate closes the other hot-air utility openings 1 to the conduit 16. In FIG. 1, the aperture extending through the gate 25 is shown aligned with the flexible hose 17 such that air can pass from the hot-air utility conduit 16 through the hose 17 while, on the other hand, the gate 25 blocks the utility openings defined by the nozzle 18 and grill 4 from the hot-air utility conduit 16.

Figure 2:
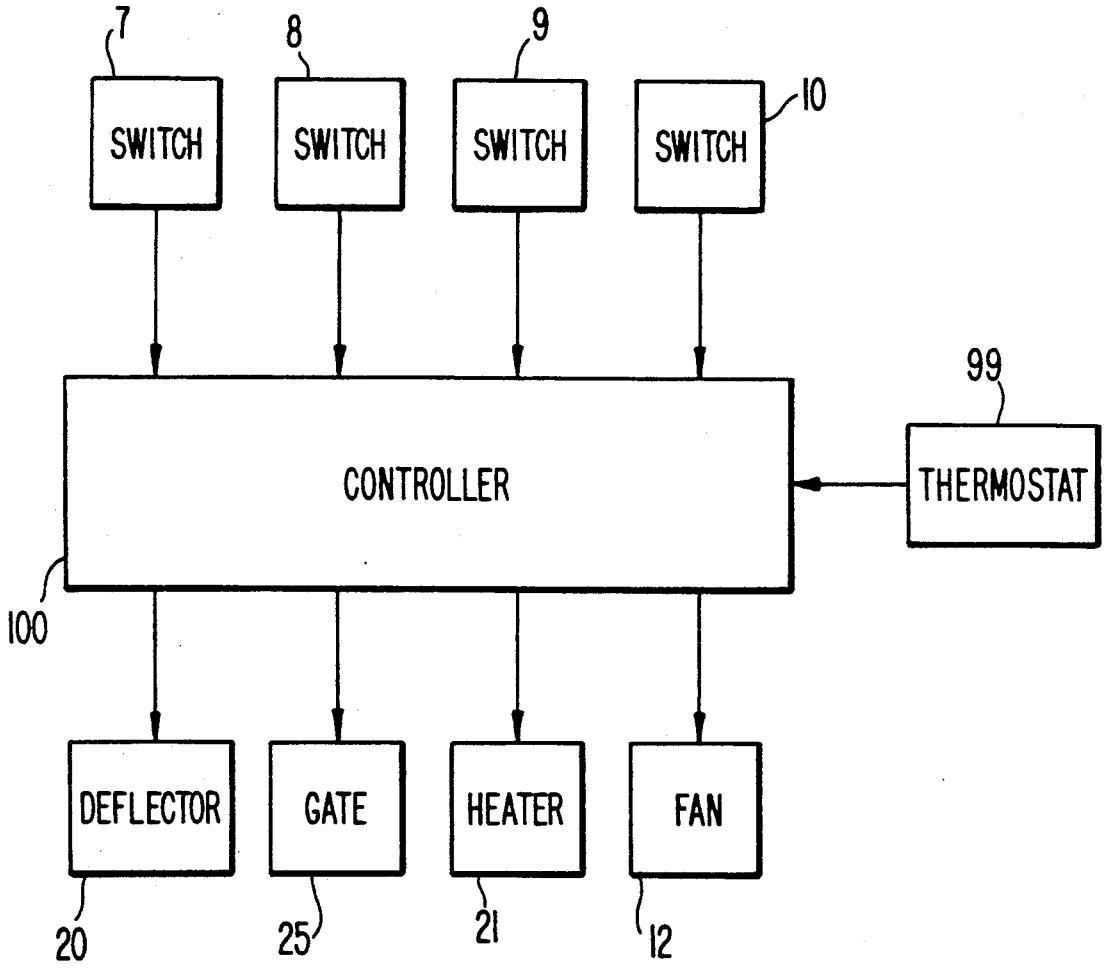
FIG. 2 is a block diagram of a selection control device of the dryer in FIG. 1.

A plurality of switches 7, 8, 9 and 10 of the selection control means are provided on the control panel of the dryer. These switches are manually operable to establish the various operating modes described below. As shown in FIG. 2, the selection control means includes a machine controller 100 of a type readily known to those of ordinary skill in the art, to which the switches 7, 8, 9 and 10 are operatively connected, whereby when one of the switches is operated a signal therefrom is input to the controller 100. The controller 100 is also operatively connected to the deflector 20 and the gate 25 via the respective driving devices thereof, the heater means 21, and the fan means 12 so as to control the same based on the signal input from a respective one of the switches 7, 8, 9 and 10.

With the structure above, the selection control means is operable to place the dryer in a hair-dryer mode in which the flexible air-hose 17 is open to the drying circuit, the discharge channel 6 is closed and the fan means 12 and heater means 21 are operated. Specifically, when the switch 7 is operated, a signal is issued to the controller 100 and the controller causes the deflector 20 to assume the solid line position shown in FIG. 1, the gate 25 to also assume the position shown in FIG. 1 in which the aperture extending therethrough is aligned with the flexible hose 17, and the fan means 12 and heater means 21 to operate. Accordingly, air is drawn through intake channel 5 and past the resistive heating element of heater means 21 by the fan means 12. The fan means 12 further forces the heated hot air through hotair utility conduit 16 and into the flexible hose 17, whereby the heated air passes through the hot-air utility opening 1 defined at the end of the flexible hose 17. The flexible hose 17 can then be used to dry one's hair, for example.

The selection control means is also operable to place the dryer in a hand-dryer mode when the switch 8 is operated. In the hand-dryer mode, the nozzle 18 is open to the drying circuit, the discharge channel 6 is closed, and the fan means 12 and the heater means 21 are operated. That is, when the switch 8 is operated, the controller 100 also causes the deflector 20 to assume the solid line position shown in FIG. 1, the gate to be moved to a position in which the aperture extending therethrough is aligned with the nozzle 18, and the fan means 12 and the heater means 21 to be operated. Thus, a supply of hot air is forced through the utility opening 1 defined at the end of the nozzle 18.

Still further, when the switch 9 is operated the selection control means places the dryer in a space-heater mode in which the utility opening 1 defined by the grill 4 is opened to the drying circuit, the discharge channel 6 is closed, and the fan means 12 and the heating means 21 are operated. Specifically, the controller 100 upon receiving the signal from the switch 9 turns on the fan means 12 and the heater means 21, causes the deflector 20 to assume the solid line position shown in FIG. 1, and moves the gate 25 to a position at which the aperture extending therethrough is aligned with the duct 19. Accordingly, a supply of hot air is forced through the grill 4 to heat the area surrounding the dryer.

In this respect, the selection control means may also by provided with a thermostat 99 (FIG. 2). In this case, the space heater function can be effectively carried out under the control of the thermostat 99, in a manner similar to that of a conventional heating system. Further, for efficient heating, the grill 4 is located on the front of the dryer and may, through appropriate ductwork, be provided at the bottom front portion of the dryer.

In each of the above cases, i.e. when any of the switches 7-9 are operated, the controller 100 operates both the heater means 21 and fan means 12 to generate a supply of forced hot air.

However, when it is desired merely to ventilate the area around the dryer, the selection control means may place the dryer in an aspiration mode in which the hot-air utility openings 1 are closed to the drying circuit, the discharge channel 6 is open, and the fan means 12 is operated while the heating means 21 is not operated. Specifically, when switch 10 is operated, the controller 100 receives a signal therefrom and causes the deflector 20 to move to the phantom line position shown in FIG. 1, thereby closing the hot-air utility conduit 16 to the drying circuit. With the heating means 21 turned off and the fan means 12 operating, air is drawn through the intake channel 5 and is forced out through the discharge channel 6 without being heated. By appropriate placement of the intake and discharge channels 5 and 6, the room in which the dryer is disposed can be ventilated of disagreeable odors and/or air having a high degree of humidity.

As should be apparent from the detailed description above, the dryer of the present invention is advantageous in that a supply of forced hot air which is normally produced in the dryer to dry a load of clothes contained therein can be instead used to operate an additional accessory or accessories such as a hair-dryer, hand-dryer and/or space heater which require such a supply of forced hot air. In addition, by turning the heater means off with the selection control means, the dryer can be used merely as a ventilator. Since each of the various accessories of the dryer are run by the supply of air normally forced through the drying circuit to dry a load of clothes contained in the dryer, a very compact and energy saving device is achieved. Thus, when the dryer according to the present invention is used in a bathroom, for example, important space savings are realized and the number of appliances which must be plugged into electrical outlets can be reduced, thereby increasing safety.

Finally, it is to be noted that the present invention has been described above in connection with a preferred embodiment thereof. However, various other changes and modification will become apparent to those of ordinary skill in the art. All such changes and modifications are seen to be within the true spirit and scope of the invention as defined by the appended claims.

What is claimed is:

1. A clothes dryer comprising:

a basket for accommodating a load of clothes to be dried;

an intake channel in communication with the interior of said basket and with the exterior of the dryer, said intake channel defining a path along which air from the exterior of the dryer can pass to the interior of the basket to dry clothes therein;

heater means in operative association with said intake channel for heating air drawn into said intake channel from the exterior of the dryer;

a discharge channel communicating with the interior of said basket and with the exterior of the dryer, said discharge channel defining a path along which air can be vented from the interior of said basket to the exterior of the dryer, whereby said intake and said discharge channels constitute a drying circuit with the interior of said basket;

fan means in operative association with said drying circuit for drawing air from the exterior of the dryer into said intake channel;

at least one hot air utility opening open to the exterior of the drier;

a hot-air utility conduit communicating with said hot-air utility opening, and with said drying circuit at a location downstream of said heating means with respect to the direction in which air will be induced to flow through the drying circuit by said fan means; and selection control means for selectively opening said at least one hot-air utility opening to said drying circuit while closing said discharge channel, and closing said at least one hot-air utility opening to said drying circuit while opening said discharge channel.

2. A clothes dryer as claimed in claim 1, wherein said selection control means is operatively connected to said fan means and to said heater means to control the operation thereof independently of one another, said selection control means is operable to place the dryer in an aspiration mode in which said hot-air utility opening is closed to said drying circuit, said discharge channel is open, and said fan means is operated while said heater means is not operated, and said selection control means includes a switch on the dryer which is manually operable to establish said aspiration mode.

3. A clothes dryer as claimed in claim 1, wherein said selection control means includes a deflector disposed at said location at which the hot-air utility conduit communicates with said drying circuit, said deflector being movable between a first position at which said deflector blocks the flow of air through said drying circuit while opening said hot-air utility conduit to said drying circuit and a second position at which the deflector closes said hot-air utility conduit to said drying circuit.

4. A clothes dryer as claimed in claim 1, wherein the dryer has a grill mounted thereto and defining said hot-air utility opening, said selection control means is operatively connected to said fan means and to said heater means so as to control the operation thereof, said selection control means is operable to place the dryer in a space-heater mode in which the hot-air utility opening defined by said grill is open to said drying circuit, said discharge channel is closed, and said fan means and said heater means are operated, and said selection control means includes a switch on the dryer which is manually operable to establish said space-heater mode 5. A clothes dryer as claimed in claim 4, wherein said selection control means includes a thermostat, and said fan means and said heater means are operated in said space-heater mode under the control of said thermostat.

6. A clothes dryer as claimed in claim 4, wherein said grill is located on the front of the dryer.

7. A clothes dryer as claimed in claim 1, wherein the dryer has a nozzle mounted thereto and defining said hot-air utility opening at an end thereof, said selection control means is operable to place the dryer in a hand-dryer mode in which said nozzle is open to said drying circuit, said discharge channel is closed, and said fan means and said heater means are operated, and said selection control means includes a switch on the dryer which is manually operable to establish said hand-dryer mode.

8. A clothes dryer as claimed in claim 1, wherein the dryer includes a flexible air-hose, said air hose defining said hot-air utility opening at one end thereof and connected to said hot-air utility conduit at the other end thereof, said selection control means is operable to place the dryer in a hair-dryer mode in which said flexible air-hose is open to said drying circuit, said discharge channel is closed, and said fan means and said heater means are operated, and said selection control means includes a switch on the dryer which is manually operable to establish said hair-dryer mode.

9. A clothes dryer comprising:

a basket for accommodating a load of clothes to be dried;

an intake channel in communication with the interior of said basket and with the exterior of the dryer, said intake channel defining a path along which air from the exterior of the dryer can pass to the interior of the basket to dry clothes therein;

heater means in operative association with said intake channel for heating air drawn into said intake channel from the exterior of the dryer;

a discharge channel communicating with the interior of said basket and with the exterior of the dryer, said discharge channel defining a path along which air can be vented from the interior of said basket to the exterior of the dryer, whereby said intake and said discharge channels constitute a drying circuit with the interior of said basket;

fan means in operative association with said drying circuit for drawing air from the exterior of the dryer into said intake channel;

a flexible air-hose mounted to the dryer and defining a first hot-air utility opening at one end thereof communicating with the exterior of the dryer;

a nozzle defining a second hot-air utility opening at one end thereof communicating with the exterior of the dryer;

a grill mounted to the dryer at the outside thereof and defining a third hot-air utility opening communicating with the exterior of the dryer;

at least one hot-air utility conduit communicating with said hot-air utility openings, and with said drying circuit at a location downstream of said heating means with respect to the direction in which air will be induced to flow through the drying circuit by said fan means; and selection control means for selectively respectively opening said hot-air utility openings to said drying circuit while closing said discharge channel, and collectively closing said hot-air utility openings to said drying circuit while opening said discharge channel.

10. A clothes dryer as claimed in claim 9, wherein said selection control means is operatively connected to said fan means and to said heater means to control the operation thereof independently of one another, said selection control means is operable to place the dryer in an aspiration mode in which said hot-air utility openings are closed to said drying circuit, said discharge channel is open, and said fan means is operated while said heater means is not operated, and said selection control means includes a switch on the dryer which is manually operable to establish said aspiration mode.

11. A clothes dryer as claimed in claim 9, wherein said at least one hot-air utility conduit is a single conduit communicating with each of said hot-air utility openings, said selection control means includes a deflector disposed at said location at which said single conduit communicates with said drying circuit, said deflector being movable between a first position at which said deflector blocks the flow of air through said drying circuit while opening said single conduit to said drying circuit and a second position at which the deflector closes said single conduit to said drying circuit, and a gate disposed in said single conduit, said gate having an aperture extending therethrough, and said gate being movable between respective positions at which said aperture is placed in communication with one of said hot-air utility openings while the gate closes the others of said hot-air utility openings to said single conduit.

12. A clothes dryer as claimed in claim 9, wherein said selection control means is operatively connected to said fan means and to said heater means so as to control the operation thereof, said selection control means is operable to place the dryer in a space-heater mode in which the hot-air utility opening defined by said grill is open to said drying circuit, said discharge channel is closed, and said fan means and said heater means are operated, and said selection control means includes a switch on the dryer which is manually operable to establish said space-heater mode.

13. A clothes dryer as claimed in claim 12, wherein said selection control means includes a thermostat, and said fan means and said heater means are operated in said space-heater mode under the control of said thermostat.

14. A clothes dryer as claimed in claim 9, wherein said grill is located on the front of the dryer.

* * * * *